United States Patent [19]

Germani

[11] 4,044,800

[45] Aug. 30, 1977

[54] LOOM WITH SHUTTLES

[75] Inventor: Cesare Germani, Como, Italy

[73] Assignee: Omita S.p.A., Italy

[21] Appl. No.: 659,950

[22] Filed: Feb. 20, 1976

[30] Foreign Application Priority Data

Feb. 27, 1975 Switzerland ..... 2483/75

[51] Int. Cl.[2] ..... D03d 51/40

[52] U.S. Cl. ..... 139/341; 139/439

[58] Field of Search ..... 139/336, 336.6, 341, 139/344, 349, 370.1, 370.2, 372, 437, 439

[56] References Cited

U.S. PATENT DOCUMENTS

| | | | |
|---|---|---|---|
| 2,386,706 | 10/1945 | Moessinger | 139/336 |
| 3,373,773 | 3/1968 | Balentine et al. | 139/336 |
| 3,416,572 | 12/1968 | Giavini | 139/439 |
| 3,543,807 | 12/1970 | Moessinger | 139/439 |
| 3,563,281 | 2/1971 | Pfarrwaller | 139/336 |
| 3,880,197 | 4/1975 | Bucil et al. | 139/436 |

*Primary Examiner*—Henry S. Jaudon

*Attorney, Agent, or Firm*—Weingarten, Maxham & Schurgin

[57] ABSTRACT

A monitoring system for the shuttle movements in a loom of the multiple moving shuttle type. Sensors are located at the end of shuttle travel through the shed, at the beginning and end of its recycling travel back to the transporting drum, and phase sensors are provided to indicate proper position of the transporting drum. Whenever any of the sensors detects a fault in the position or phase of the shuttle or transporting drum, the fault is indicated and the loom is normally shut down until the fault is cleared.

4 Claims, 4 Drawing Figures

LOOM WITH SHUTTLES

FIELD OF THE INVENTION

The present invention relates generally to a loom with a weft bobbin located outside the shed, the feeding of the weft into the shed being accomplished by shuttles which are brought into the shooting position by a rotary transporting drum, and more specifically to such a loom having a monitoring system to detect faults in the position of the shuttles and the transporting drum.

DISCUSSION OF THE PRIOR ART

Looms of the type mentioned above are already known. In a known loom with such shuttles a rotary transporting drum is used in order to bring the shuttles into the firing position, whereby the weft is introduced into the weft gripping device of the shuttle by means of compressed air. After passing through the shed the shuttle is braked in a braking device, the weft is detached and the shuttle is returned on a conveyor belt to the transporting drum. If such a movement sequence is not carried out correctly faults can occur in the woven product. This applies to all the movement sequences in which the shuttle is not positively moved. In many such prior art looms there is no monitoring or sensing system to detect such operating problems.

SUMMARY OF THE INVENTION

The present invention is a loom of the type indicated hereinbefore wherein all the essential movements of the shuttle are monitored, whereby if a fault occurs the loom is stopped and the fault indicated.

According to the invention the circular path of each shuttle is provided with monitoring devices at several points by means of which the shuttle movements can be checked on a time or phase basis or both. As a result the shuttle is monitored constantly as it travels throughout its path and the loom only continues to operate if each segment of movement of the shuttle has correctly taken place in its cylical path and this has been indicated.

BRIEF DESCRIPTION OF THE DRAWING

The features, advantages and objects of the present invention will be apparent from the following description when read in conjunction with the accompanying drawing in which.

DETAILED DESCRIPTION OF THE PREFERRED EMBODIMENT

Figures 1, 3:
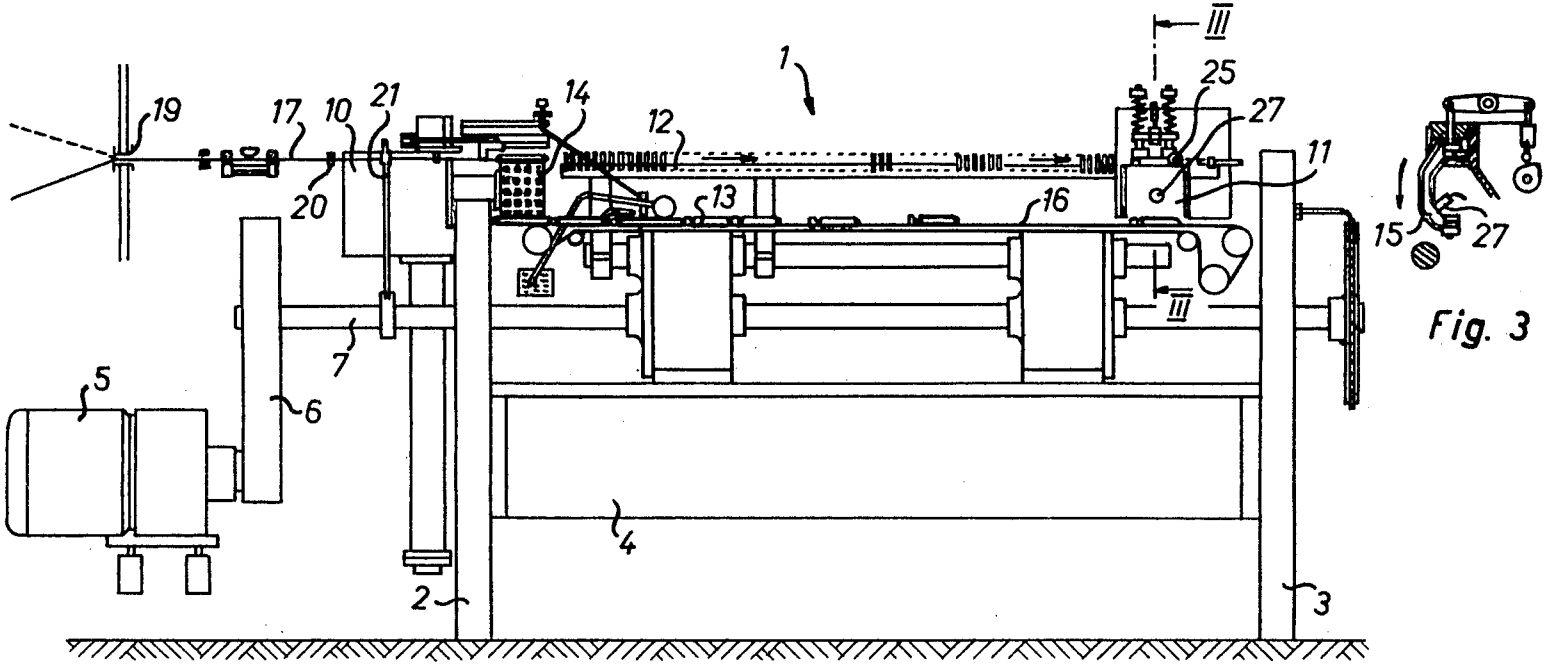
FIG. 1 is a side view of a schematically represented loom with shuttles.
FIG. 3 is a partial sectional view taken along the line III — III of FIG. 1.
Figure 2:
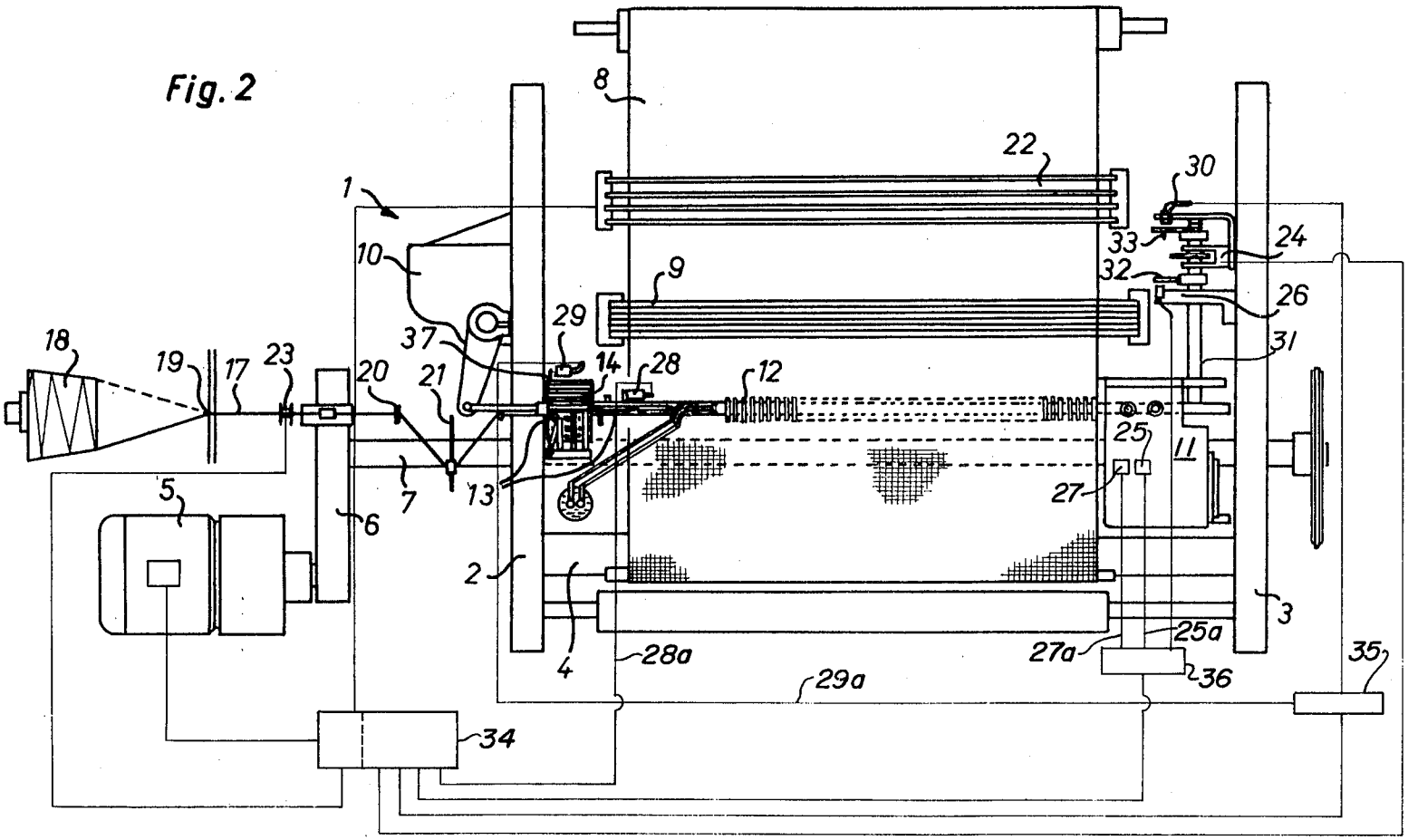
FIG. 2 is a plan view of the loom of FIG. 1.

With reference now to the drawing and more particularly to FIGS. 1 and 2 thereof, there is shown loom 1 having a frame, substantially comprising a left-hand side plate 2, a right-hand side plate 3 and a longitudinal member 4 interconnecting the two side plates 2 and 3. A motor 5 of conventional type such as a geared motor is positioned on or alongside the left-hand side plate 2 and by means of a belt drive 6 comprising pulleys and a belt, drives a longitudinal main shaft 7. The main shaft 7 is used to drive continuously or intermittently all the components necessary for the operation of the loom 1, including a warp beam (not shown), a warp 8, shafts 9 for opening, closing and changing the shed and a fabric beam (not shown) for winding on the fabric. Main shaft 7 also drives and/or actuates a shooting device 10, a gripping device 11, and a sley 12.

Shuttles 13 are brought into their firing position by a rotary transporting drum 14, are shot by shooting device 10 on sley 12 through the particular open shed, are braked by the gripping device 11 at the other end of the loom, are placed top downward on a conveyor belt 16 by a curved guide shaft or chute 15 (FIG. 3) which returns them to the transporting drum 14. Prior to shooting the shuttle 13, a weft 17 taken from a fixed weft bobbin 18, located outside the shed, via thread guides 19,20, is passed into the shuttle which is ready for firing with the interpositioning of a weft store 21 and is held by the same in sprung clips.

In loom 1 it is important that in addition to a monitoring device 22 for the warp threads and monitoring devices 23 and 24 for monitoring the weft and the thread position thereof, that the individual movement sequences of shuttle 13 are also monitored. To this end a non-contacting sensor 25 is incorporated in the gripping device 11 which determines the passage of the shuttle 13 and the precise entrance thereof into the gripping device. However, it is not enough to merely determine the correct position of shuttle 13 in gripping device 11 because it is also necessary to establish that the entry of shuttle 13 into gripping device 11 takes place in a particular zone in phase with the loom movement, for which purpose a sensor 26 is used.

It is also important to monitor by means of a further sensor 27 the regular dropping of the shuttle 13 introduced into chute 15 by gripping device 11.

In addition, it is important to establish the presence of a shuttle 13 in front of the transporting drum by using a further sensor 28. Finally, it is also essential that the movement and phase of transporting drum 14 be monitored by a further sensing device 29, 30.

The signals produced by sensors 22–30 can be processed in known manner, in that when a fault signal occurs the loom 1 is appropriately stopped and the point at which the fault has occurred is, for example, indicated by a corresponding visual signal. Further, the sensors may be of any well-known type.

Figure 4:
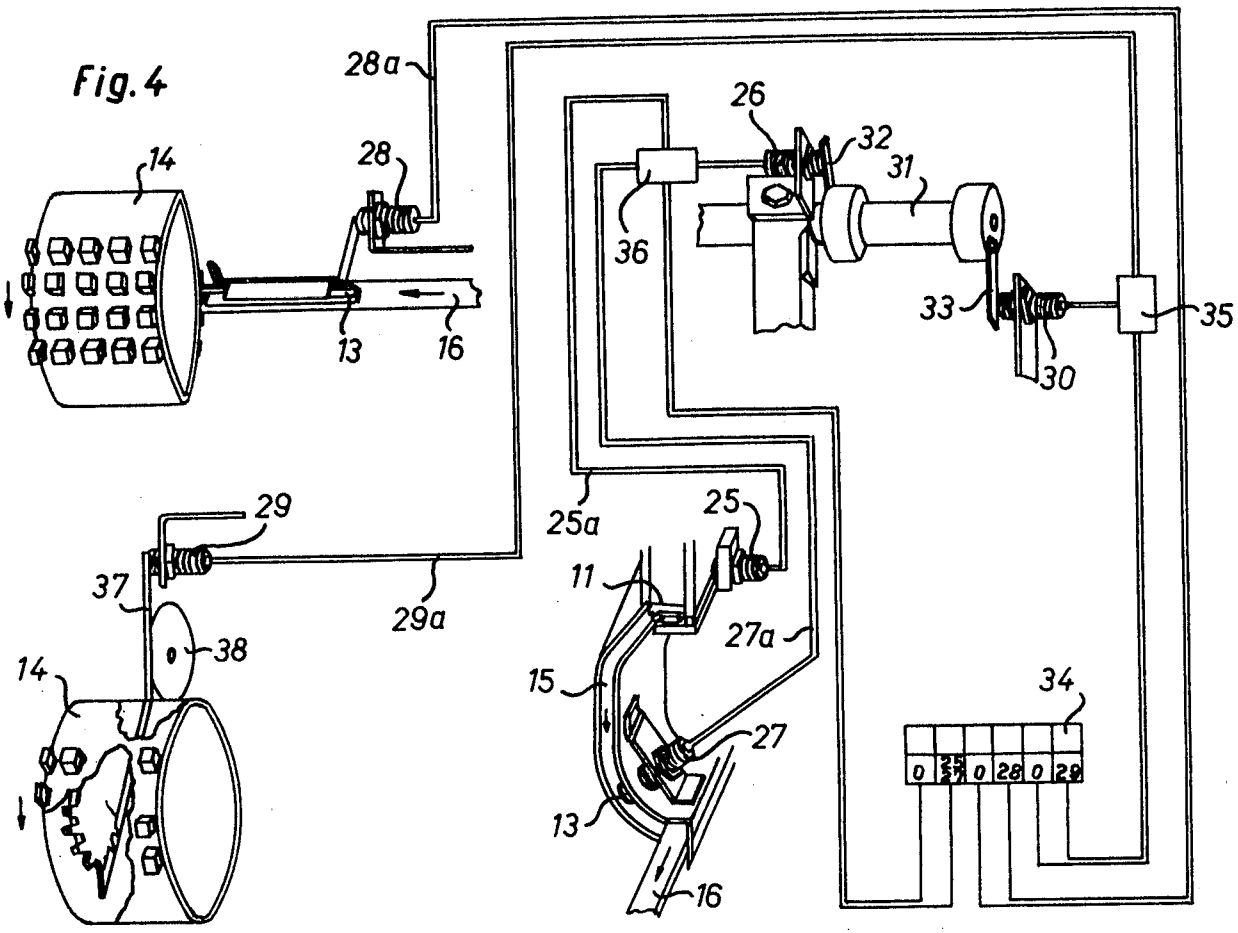
FIG. 4 is a pictorial representation of the system components for monitoring the shuttle rotation.

FIG. 4 pictorially represents the interaction of sensors 25 to 30 provided for monitoring the rotation of shuttle 13. A control shaft 31, to which two contact pointers 32, 33 are fixed in different angular positions and which is driven by the main shaft 7 is used for checking the phase position. Together with the non-contacting sensors 26 and 30, contact pointers 32, 33 determine the phase position of the individual monitoring operations.

Errors in the passage of shuttles 13 are indicated on a visual indicating device 34. Sensors 25, 27 and 29 are connected by means of respective connecting lines 25*a*, 27*a* and 29*a* to the indicating device 34, with the interpositioning of comparators 35, 36. The phase position of sensors 25 and 27 is compared with that of sensor 26 in comparator 36 and the phase position of sensor 29 is compared with that of sensor 30 in comparator 35. If the corresponding relevant pulses do not coincide an indication takes place on indicating device 34. No comparison with the phase position is necessary for sensor 28, so that line 28*a* is directly connected with indicating device 34. Therefore an indication resulting from a fault detected by sensor 28, which may optionally be linked with the stopping of the loom, only takes place when a shuttle 13 is not supplied by conveyor belt 16 to transporting drum 14.

For graphical reasons the transporting drum 14 is shown twice in FIG. 4. Sensor 29 checks the correct position of transporting drum 14 by establishing the correct position of a locking lever 37, which is moved by an eccentric 38 and meshes with a tooth system provided on drum 14. If drum 14 is not in the correct position the locking lever cannot engage, which fault is detected by sensor 29 thereby stopping the loom and simultaneously indicating the error on indicating device 34.

As a result of the described monitoring device the movement sequences of shuttle 13, which are largely not positively performed, are accurately monitored, so that when a fault occurs, damage is avoided by immediately stopping loom 1. In addition when the problem is cleared, restarting of the loom is easily accomplished by known means.

A detailed explanation of the operation of the loom with the monitoring system of this invention and specific examples of its operation follow hereinbelow. The loom makes one complete cycle for each revolution of 360° of the main shaft 7. The 0° position of shaft 7 coincides with the end of the time during which sley 12 is still stationary in a position in which it is completely to the rear of the weaver's station. At 50° the sley is fully advanced (for beating-up) and at 100° the sley is back in its fully rearward position and stationary. At 110 to 115°, the shuttle is picked. At 305° the contact pointer 32 is in front of proximity detector 26 (FIG. 4); if any single one of the electronic circuits of the memory kind (proximity detectors 25, 27, 29 or 30) refuses to permit further motion of the loom, detector 26 outputs a stop signal to the electronic control station 34. At the control station the signal from sensor 26 triggers release of the electro-mechanical coupling between the loom driving motor 5 and belt drive 6 while simultaneously engaging an electro-magnetic braking disk. Even at very high loom speeds the loom stops at about 340° to 345°, that is, early enough for the sley not to have begun its movement for the next cycle.

The number of gripper shuttles 13 circulating in the loom under consideration and in similar looms is from 25 to 30 per second depending upon the working width of the loom and upon the speed of the shuttle return belt 16. The non-positive movements of the gripper shuttles of the loom under consideration and which the present invention seeks to monitor are as follows: a) the flight of the shuttle through the shed in appropriate guides on the sley; b) the dropping (with overturning) of the shuttle from the gripping device 11 to the shuttle return belt 16; and c) correct insertion of the shuttle in the appropriate recess in drum 14 on the picking side from the shuttle return belt 16. The electronic controls of this invention also provide the following checks: d) proper position of drum 14 on the picking side; e) integrity of all warp yarns (warp stop motion); and f) integrity of the weft yarn.

If, for example, there are 25 shuttles circulating in the loom, at 305° the proximity detector 26 (FIG. 4) does not stop the loom if the 25th shuttle, that is, the shuttle most recently picked, has reached the gripping device 11 before 305°, that is, if the proximity detector 25 has given permission for the loom movement to continue. Nor does the loom stop if the 24th shuttle, that is, the penultimately picked shuttle, has entered the chute 15 properly and if the proximity detector 27 has given permission for loom movement to continue.

If a shuttle thrust by the conveyor belt has entered its proper groove or recess in the picking side drum 14 but in a different way so that part of the shuttle is in the drum groove and part is remaining on the shuttle return belt, a safety trap or door or the like would have triggered proximity detector 28 which would in turn have stopped the loom. Proximity detector 29 permits loom movement to continue if drum 14 has rotated through one 18th of a revolution to bring the first gripper shuttle into the line for picking. Proximity detector 30 permits loom movement to continue if the signal from the weft stop motion 23 (FIG. 2) has not been interrupted between the departure and the arrival of the 25th shuttle. Also, the warp stop motion 22 (FIG. 2) must be opened electrically if the electronic control station is not to stop the loom.

The invention is not limited to the embodiments described and represented hereinbefore and various modifications can be made thereto by those skilled in the art which are within the scope of the invention.

What is claimed is:

1. A loom having a monitoring system, said loom being of the type having a weft bobbin located outside the shed, the weft is fed into the shed by means of shuttles which are brought into a shooting position by a rotary transporting drum, said shuttles being braked after passing through the shed carrying the weft, said shuttles pass through a chute from the braking means to a conveyor belt and are then returned to the transporting drum by the conveyor belt, the operation of said shuttles and the position in the cylical path of each shuttle being monitored by said monitoring system which comprises:

first sensing means in said braking means for determining the position of said shuttle after passing through said shed;

second sensing means in said chute for determining the position of said shuttle at the beginning of its return movement;

third sensing means adjacent said transporting drum for determining the presence of said shuttle at the end of its return movement; and fourth sensing means for detecting the rotational phase of said transporting drum with respect to the loom movement.

2. The loom according to claim 1 and further comprising visual indicating means coupled to each of said first, second, third and fourth sensing means for providing visual indication of a fault detected by said sensors.

3. The loom according to claim 2 and further comprising:

fifth sensing means for detecting the phase of movement of said loom; and first means for comparing the signal from said fifth sensing means with signals from said first and second sensing means, the signal from said first comparing means being coupled to said indicating means.

4. The loom according to claim 3 and further comprising:

sixth sensing means for detecting the phase of movement of said loom; and second means for comparing the signal from said sixth sensing means with the signal from said fourth sensing means, the signal from said second comparing means being coupled to said indicating means.

* * * * *